US005258275A

United States Patent [19]

Arai et al.

[11] Patent Number: 5,258,275

[45] Date of Patent: Nov. 2, 1993

[54] SILVER HALIDE PHOTOGRAPHIC LIGHT-SENSITIVE MATERIAL AND THE PROCESS OF PREPARING THE SAME

[75] Inventors: Takeo Arai; Toshiharu Nagashima, both of Hino, Japan

[73] Assignee: Konica Corporation, Tokyo, Japan

[21] Appl. No.: 968,266

[22] Filed: Oct. 30, 1992

Related U.S. Application Data

[63] Continuation of Ser. No. 883,913, May 12, 1992, abandoned, which is a continuation of Ser. No. 595,289, Oct. 10, 1990, abandoned.

[30] Foreign Application Priority Data

Oct. 13, 1989 [JP] Japan ..... 1-266640

[51] Int. Cl.[5] ..... G03C 1/76

[52] U.S. Cl. ..... 430/523; 430/531; 430/539; 430/950

[58] Field of Search ..... 430/523, 531, 539, 950

[56] References Cited

U.S. PATENT DOCUMENTS

| | | | |
|---|---|---|---|
| 4,232,117 | 11/1980 | Naoi et al. | 430/523 |
| 4,499,179 | 2/1985 | Ota et al. | 430/523 |
| 4,524,131 | 6/1985 | Himmelmann et al. | 430/523 |
| 4,895,792 | 1/1990 | Aizawa et al. | 430/523 |

FOREIGN PATENT DOCUMENTS

| | | | |
|---|---|---|---|
| 35898 | 10/1981 | Japan . | |
| 56-132334 | 10/1981 | Japan . | |
| 58-62648 | 4/1983 | Japan . | |
| 161296 | 4/1983 | Japan . | |
| 5235 | 1/1987 | Japan | 430/523 |
| 74504 | 10/1987 | Japan . | |
| 62-231252 | 10/1987 | Japan . | |

*Primary Examiner*—Hoa Van Le

*Attorney, Agent, or Firm*—Finnegan, Henderson, Farabow, Garrett & Dunner

[57] ABSTRACT

A method of preparing a light sensitive silver halide photographic material is disclosed. In the method a coated layer surface temperature is not higher than 19° C. when a percentage of water to binder is within the range of 800–200% by weight on a side coated with the light sensitive silver halide emulsion layer, and the light sensitive material can be dried up by taking not shorter than 35 seconds to get a percentage within the range of 800–200% by weight. A light sensitive photographic material is also disclosed. The material has a specific surface smoothness degree and contains matting agent, and is prepared by above-mentioned method.

6 Claims, No Drawings

SILVER HALIDE PHOTOGRAPHIC LIGHT-SENSITIVE MATERIAL AND THE PROCESS OF PREPARING THE SAME

This application is a continuation, of application Ser. No. 07/883,913, filed May 12, 1992, which is a continuation of application Ser. No. 07/595,289, filed Oct. 10, 1990, both now abandoned.

FIELD OF THE INVENTION

This invention relates to a silver halide photographic light-sensitive material for graphic arts use -hereinafter referred simply to as a light-sensitive material- and the process of preparing the same and, more particularly, to a light-sensitive material excellent in both aging-preservability and vacuum-adhesion when making a contact-exposure to light.

BACKGROUND OF THE INVENTION

In the field of graphic arts, there are serious demands for light-sensitive materials excellent in aging preservability so that the inventory management of the light-sensitive materials can be rationalized. Particularly, for light-sensitive materials applied with a matting agent onto the surfaces thereof, there has been a requirement for developing a means for improving the density thereof lowered seriously by aging them. Further, in the field of the art, there have recently been the requirement for shortening the vacuum-adhesion time in exposing the light-sensitive materials to light. In particular, there have been demands for providing light-sensitive materials capable of being exposed to light even within the range of not longer than 10 seconds for the vacuum-adhesion time. The present inventors have discovered that, as disclosed in Japanese Patent Application No. 1-228762/1989 for example, it can be effective, for the vacuum-adhesion improvements, to contain not less than 4 mg/m$^2$ of a matting agent having an average particle-size of not smaller than 4 μm, for example, in a light-sensitive material, and to set a smooster value to be not less than 25 mg/mmHg. On the other hand, it was also found the fact that, when using such a relatively large-sized matting agent therein, the density of the light-sensitive material is further lowered by aging, so that the fact mentioned above has been a barrier to put the vacuum-adhesion techniques to practical use.

SUMMARY OF THE INVENTION

It is an object of the invention to provide a process of manufacturing a light-sensitive material having a density scarcely lowered by aging.

Another object of the invention is to provide a light-sensitive material which has an excellent vacuum-adhesion in exposing it to light and has a density scarcely lowered by aging.

A further object of the invention is to provide a light-sensitive material clear in discrimination between the obverse and reverse surfaces.

The process of manufacturing a silver halide photographic light-sensitive material of the invention comprises a coating and drying process for the light-sensitive material comprising a support coated thereon with at least one of light-sensitive emulsion layers; wherein the coated layer surface temperature is not higher than 19° C. when a percentage of water to binders is within the range of 800–200% by weight on the side coated with the light-sensitive silver halide emulsion layer of the light-sensitive material, and the light-sensitive material can be dried up by taking not shorter than 35 seconds to get a percentage within the range of 800–200% by weight.

In the invention, it is desirable that regular-formed or amorphous matting agents each having a particle-size of not smaller than 4 μm are contained in an amount of not less than 4 mg/m$^2$ in the outermost layer on the side coated with a silver halide emulsion layer, that the surface smoothness degree of the layer is not less than 4 mg/m$^2$, and that the matting agents each having a particle-size of less than 4 μm are desirably contained therein.

DETAILED EXPLANATION OF THE INVENTION

A light-sensitive material may be obtained by coating and drying in the following manner. A support is coated with a coating solution ordinarily comprising a composition in which a hydrophilic colloid such as gelatin is used and is then cooled down to be coagulated in a low temperature atmosphere having a dry-bulb temperature of −10°–15° C. Next, the water content of a coated layer is evaporated to be removed by raising the temperature. At this instance, the proportion of gelatin to water content is normally about 2000% by weight at the time immediately after completing the coating operation. In the drying step, the drying time and the surface-coating temperature could display the improvement effects on the density lowered by aging, when the proportion by weight of water to gelatin is within the range of 800–200% by weight.

In the invention, the term, 'a surface-coating temperature, is expressed by the wet-bulb temperature' of the dried air, and the value, in a proportion of water to gelatin within the range of 800–200% by weight, is, preferably, not higher than 19° C. and, more particularly, not higher than 17° C. The drying time from 800% to 200% is, preferably, not shorter than 35 seconds and, more preferably, not shorter than 40 seconds.

The surface smoothness degree is a value measured by the method defined in "JAPAN TAPPI Test Method for Paper and Pulp No. 5-74" using an air-micrometer type testing apparatus.

The values of the smoothness in terms of "smooster" used in the invention are measured with an instrument, Model SM-6B manufactured by Toh-Ei Electronic Industrial Company.

As for the matting agents applicable to the invention, any one of the well-known can be used. For example, the particles of inorganic substances including silica described in Swiss Patent No. 330,158; glass powder described in French Patent No. 1,296,995; alkaline earth metals or the carbonates of cadmium or zinc, each described in British Patent No. 1,173,181; the particles of organic substances including starch described in U.S. Pat. No. 2,322,037; starch derivatives described in Belgian Patent No. 625,451 or British Patent No. 981,198; polyvinyl alcohol described in Japanese Patent Examined Publication No. 44-3643/1969; polystyrene or polymethyl methacrylate described in Swiss Patent No. 330,158; polyacrylonitrile described in U.S. Pat. No. 3,079,257; and polycarbonate described in U.S. Pat. No. 3,022,169.

The above-given matting agents may be used independently or in combination. As for the regular-formed matting agents, those in the globular form are preferably used, however, the other formed matting agents such as those in the tabular or cubic form may also be used. The sizes of the matting agents are expressed by the diameters thereof obtained each by converting the volumes of the matting agents into the volume thereof in the globular forms. In the invention, the term, 'a mat particle-size', means a globular particle diameter obtained by converting the volume of a matting agent particle into the volume of the globular particle.

In the preferable embodiments of the invention, the outermost layer on the emulsion layer side contains at least one kind of the regular-formed and/or amorphous matting agents having a mat particle-size of not smaller than 4 μm in an amount within the range of 4–80 mg/m$^2$. It is more preferable that the above-mentioned outermost layer on the emulsion layer side also contains at least one kind of the other regular-formed and/or amorphous matting agents having a particle-size of smaller than 4 μm in an amount within the range of 4 mg/m$^2$–80 mg/m$^2$.

That a matting agent is contained in the outermost layer means the case where at least one part of the matting agent may be contained in the outermost layer, and another case where a part of the matting agent is contained also in the layers arranged lower than the outermost layer, as well as in the outermost layer.

It is preferable to expose a part of the matting agent to the surface of the layer so that the basic functions of the matting agent can be performed.

The matting agent exposed to the surface of the layer may be a part or the whole thereof. The matting agents may be added thereinto either in a method in which the matting agents are dispersed in advance into a coating solution so that they may be coated or in another method in which, after the coating solution is coated and the matting agents are sprayed before the coating solution is not dried up. When adding the different kinds of matting agents, the above-described two methods may be used in combination.

Into the silver halide emulsions applicable to the light-sensitive materials of the invention, it is allowed to use any kinds of silver halides such as silver bromide, silver iodobromide, silver chloride, silver chlorobromide and silver chloroiodobromide, which may be used in any ordinary types of silver halide emulsions. These silver halides include, preferably, silver chlorobromide containing silver chloride in a proportion of not less than 50 mol %, for using as a negative type silver halide emulsion.

The silver halide grains may be obtained in any one of an acidic method, a neutral method and an ammoniacal method. The silver halide emulsions applicable to the invention may have either a single composition or plural different compositions of the grains contained in a single layer or in plural layers separately.

The silver halide grains relating to the invention may be used in any configurations. One of the preferable examples thereof is a cube having the crystal surfaces of {100} faces. On the other hand, it is allowed to prepare the grains having an octahedral, tetradecahedral or dodecahedral configuration in the method described in, for example, U.S. Pat. Nos. 4,183,756 and 4,225,666; Japanese Patent O.P.I. Publication No. 55-26589/1980; Japanese Patent Examined Publication No. 55-42737/1980; and the literature such as The Journal of Photographic Science, 21.39, 1973. It is further allowed to use the grains having twin crystal faces.

As for the silver halide grains relating to the invention, it is allowed to use the grains having a single configuration or a mixture of the grains having various configurations.

Besides the above, it is also allowed to use an emulsion having any grain-size distribution, an emulsion having a wide grain-size distribution -hereinafter referred to as a polydisperse type emulsion-, and/or an emulsion having a narrow grain-size distribution -hereinafter referred to as a monodisperse type emulsion; each may be used independently or in combination in the form of a mixture. It is further allowed to use a mixture of the polydisperse type emulsions and the monodisperse type emulsions.

As for the silver halide emulsions, it is allowed to use a mixture of not less than two kinds of silver halide emulsions having been prepared separately.

The term, 'a grain-size' stated herein means a grain diameter in the case of a globular silver halide grains, and a diameter of a circular image converted from the projective image of the grain in the case of any other formed grains than the globular grains.

The grain-sizes of the silver halide can be obtained in the manner, for example, that the grains are photographed and then printed after they are magnified 10000 times to 50000 times through an electron microscope, and the diameters of the grains or the areas thereof when projecting them are practically measured on the print; provided, the number of the grains are deemed to be not less than 1000 at random.

In particularly preferable highly monodisperse type emulsions of the invention, the grain distribution degrees are defined by the following equation:

$$\frac{\text{Standard grain-size deviation}}{\text{Average grain-size}} \times 100 = \text{Distribution degree, \%}$$

The grain-size distribution degrees of such grains are not greater than 20% and, preferably, not greater than 15%.

The above-mentioned average grain-size and standard grain-size deviation are obtained from the foregoing ri.

The monodisperse type emulsions can be obtained with reference to Japanese Patent O.P.I. Publication Nos. 54-48521/1979, 58-49938/1983 and 60-122935/1985.

The light-sensitive silver halide emulsions may be used without applying any chemical desitization thereto as they are remaining in the form of the so-called primitive emulsions, however, they are usually subjected to a chemical sensitization. Such a chemical sensitization as mentioned above may be carried out in the methods described in, for example, the literatures authored by Glafkides or Zelikman; or H. Frieser, 'Die Grundlagen der Photographischen Prozesse mit Silberhalogeniden', Akademische Verlagsgesellschaft, 1968.

To be more concrete, a sulfur sensitization method in which a compound containing sulfur capable of reacting with silver ions; a reduction sensitization method in which a reducible substance is used; and a noble-metal sensitization method in which gold or the other noble metals are used; may be used independently or in combination. As for the sulfur sensitizers, a thiosulfate, a thiourea, a thiazole, a rhodanine and other compounds may be used. The typical examples are given in U.S. Pat. Nos. 1,574,944, 2,410,689, 2,278,947, 2,728,668, and 3,656,955. As for the reduction sensitizers, a stannous salt, an amine, a hydrazine derivative, a formamidinesulfinic acid and a silane compound may be used. The typical examples thereof are given in U.S. Pat. Nos. 2,487,850, 2,419,974, 2,518,698, 2,983,609, 2,983,610 and 2,694,637. For the noble-metal sensitization, the metal complex salts given in the VII group of the periodic law table, such as platinum, iridium and palladium, as well as a gold complex salt may be used. The typical examples thereof are given in U.S. Pat. Nos. 2,399,083 and 2,448,060; and British Patent No. 518,061.

There is no special limitation to the pH, pAg and temperature requirements for the chemical sensitization. It is, however, preferable that such a pH is within the range of 4–9 and, preferably, 5–8, such a pAg is within the range of 5–11 and, preferably, 8–10, such a temperature is within the range of 40°–90° C. and, preferably, 45°–75° C.

The photographic emulsions applicable to the invention may be subjected to the combination of a reduction sensitization method in which a reducible substance is used and a noble-metal sensitization method in which a noble-metal compound is used, besides the above-described sulfur sensitization method and gold sulfur sensitization method.

As for the light-sensitive emulsions, the foregoing emulsions may be used independently or in combination.

When embodying the invention, the following various types of stabilizers may also used after completing such a chemical sensitization as described above. The stabilizers include, for example, 4-hydroxy-6-methyl-1,3,3a,7-tetrazaindene, 5-mercapto-1-phenyltetrazole, and 2-mercaptobenzothiazole. If further required, it is allowed to use silver halide solvents such as thioether, or crystal-habit controllers such as a mercapto group-containing compound and a sensitizing dye.

To the silver halide grains applicable to the emulsions of the invention, metal ions may be added by making use of a cadmium salt, a zinc salt, a lead salt, a thallium salt, an iridium salt or the complex salts thereof, a rhodium salt or the complex salts thereof, or an iron salt or the complex salts thereof, in the course of forming the grains and/or in the course of growing the grains, so that the metal ions may be contained in the inside of the grains and/or on the surfaces thereof.

It is allowed that needless soluble-salts may be removed from the emulsions of the invention after completing the growth of silver halide grains, or the needless soluble-salts may be contained therein as they are. Such needless salts may be removed in the method detailed in, for example, Research Disclosure No. 17643.

In the silver halide photographic light-sensitive materials relating to the invention, the photographic emulsions thereof may also be spectrally sensitized to relatively longer wavelength blue, green, red or infrared rays of light by making use of sensitizing dyes. The dyes to be used therein include, for example, a cyanine dye, a melocyanine dye, a compound cyanine dye, a compound melocyanine dye, a holopolar cyanine dye, a hemicyanine dye, a styryl dye and a hemioxonol dye. Among them, the particularly useful dyes include, for example, those belonging to the cyanine, melocyanine and compound melocyanine dyes. To the above-given dyes, it is allowed to apply any one of the nuclei which are usually utilized, as the basic heterocyclic nuclei, in cyanine dyes. To be more concrete, the nuclei applicable thereto include, for example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus fused an alicyclic hydrocarbon ring into any one of the above-given nuclei, and a nucleus fused an aromatic hydrocarbon ring into any one of the above-given nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. The above-given nuclei may be substituted in the position of carbon atom.

It is allowed to apply the following nuclei each having a ketomethylene structure to the melocyanine or compound melocyanine dyes; namely, 5- or 6-membered heterocyclic nuclei such as a pyrazoline-5-one nucleus, a thiohydantoin nucleus, a 2-thioxazolidine-2,4-dione nucleus, a thiazolidine-2,4-dione nucleus, a rhodanine nucleus, a thiobarbituric acid nucleus.

The sensitizing dyes applicable to the invention are used in a concentration which is the same with or equivalent to the concentration of the sensitizing dyes used in the ordinary negative type silver halide emulsions. In particular, it is advantageous to use the sensitizing dyes in the order of a dye-concentration that does not substantially lower the intrinsic sensitivity of the silver halide emulsion to be used. It is preferable to use such a sensitizing dye in an amount within the range of about $1.0\times10^{-5}$ - about $5\times10^{-4}$ mols per mol of silver halide used. It is particularly preferable tp use them in an amount within the range of about $4\times10^{-5}$–$2\times10^{-4}$ mols per mol of silver halide used.

The sensitizing dyes of the invention may be used independently or in combination. The examples of the sensitizing dyes advantageously applicable to the invention include, typically, the following dyes.

The sensitizing dyes applicable to blue light-sensitive silver halide emulsion layers include, for example, those given in West Germany Patent No. 929,080; U.S. Pat. Nos. 2,231,658, 2,493,748, 2,503,776, 2,519,001, 2,912,329, 3,656,956, 3,672,897, 3,694,217, 4,025,349 and 4,046,572; British Patent No. 1,242,588; Japanese Patent Examined Publication Nos. 44-14030/1969 and 52-24844/1977; and Japanese Patent O.P.I. Publication Nos. 48-73137/1973 and 61-172140/1986. The sensitizing dyes applicable to green light-sensitive silver halide emulsions include, typically, cyanine, melocyanine or compound cyanine dyes such as those given in U.S. Pat. Nos. 1,939,201, 2,072,908, 2,739,149 and 2,945,763; British Patent No. 505,979; Japanese Patent Examined Publication No. 48-42172/1973. The sensitizing dyes applicable to red or infrared light-sensitive silver halide emulsions include, typically, cyanine, melocyanine or compound cyanine dyes such as those given in U.S. Pat. Nos. 2,269,234, 2,270,378, 2,442,710, 2,454,629 and 2,776,280; Japanese Patent Examined Publication No. 49-17725/1974; and Japanese Patent O.P.I. Publication Nos. 50-62425/1975, 61-29836/1986 and 60-80841/1985.

The above-given sensitizing dyes may be used independently or in combination. In particular, the combination of the sensitizing dyes are very often used for a super sensitization. The typical examples of the combination use thereof are detailed in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707; British Patent Nos. 1,344,281 and 1,507,803; Japanese Patent Examined Publication Nos. 43-4936/1968 and 53-12375/1978; and Japanese Patent O.P.I. Publication Nos. 52-110618/1977 and 52-109925/1977.

For hardening the light-sensitive materials of the invention so as to be suitable for graphic arts, it is desired to contain therein at least one kind of tetrazolium compound and/or at least one kind of hydrazine compound.

The tetrazolium compounds applicable to the invention include, for example, the compounds represented by the following formula I:

Formula I

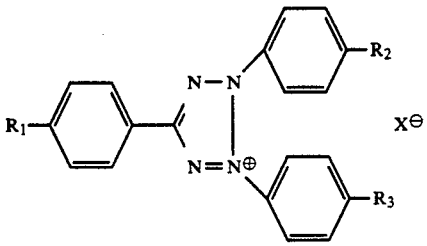

wherein the preferable substituents represented by $R_1$ or $R_3$ include, for example, alkyl groups such as a methyl group, an ethyl group, a cyclopropyl group, a propyl group, an isopropyl group, a cyclobutyl group, a butyl group, an isobutyl group, a pentyl group and a cyclohexyl group; amino groups; acylamino groups such as an acetylamino group; hydroxyl groups; alkoxy groups such as a methoxy group, an ethoxy group, a propoxy group, a butoxy group and a pentoxy group; acyloxy groups such as an acetyloxy group; halogen atoms such as a fluorine atom, a chlorine atom and a bromine atom; carbamoyl groups; acylthio groups such as an acetylthio group; alkoxycarbonyl groups such as an ethoxycarbonyl group; carboxyl groups; acyl groups such as an acetyl group; cyano groups; nitro groups; mercapto groups; sulfoxy groups; and aminosulfoxy groups.

The anions represented by the foregoing $X^{\ominus}$ include, for example, halogen ions such as a chloride ion, a bromide ion and an iodide ion; the acid radicals of inorganic acids such as nitric acid, sulfuric acid and perchloric acid; the acid radicals of organic acids such as sulfonic acid and carboxylic acid and, besides, anionic activators including, typically, lower alkylbenzenesulfonic acid anions such as p-toluenesulfonic acid anion; higher alkylbenzenesulfonic acid anions such as p-dodecylbenzenesulfonic acid anion; higher alkylsulfuric acid ester anions such as laurylsulfate anion; boric acid type anions such as tetraphenyl boron; dialkylsulfosuccinate anions such as di-2-ethylhexylsulfosuccinate anion; polyetheralcohol sufuric acid ester anions such as cetylpolyethenoxysulfate anion; higher aliphatic anions such as stearic acid anion; and polymers attached with acid radicals such as that of polyacrylic acid anion.

The typical examples of the compounds represented by Formula I, which are applicable to the invention, will be given in the following Table T. It is, however, to be understood that the compounds of the invention shall not be limited thereto.

TABLE T

| Compound No. | $R_1$ | $R_2$ | $R_3$ | $X^{\ominus}$ |
|---|---|---|---|---|
| I-1 | H | H | H | $Cl^{\ominus}$ |
| I-2 | H | p-$CH_3$ | p-$CH_3$ | $Cl^{\ominus}$ |
| I-3 | H | m-$CH_3$ | m-$CH_3$ | $Cl^{\ominus}$ |
| I-4 | H | o-$CH_3$ | o-$CH_3$ | $Cl^{\ominus}$ |
| I-5 | p-$CH_3$ | p-$CH_3$ | p-$CH_3$ | $Cl^{\ominus}$ |
| I-6 | H | p-$OCH_3$ | p-$OCH_3$ | $Cl^{\ominus}$ |
| I-7 | H | m-$OCH_3$ | m-$OCH_3$ | $Cl^{\ominus}$ |
| I-8 | H | o-$OCH_3$ | o-$OCH_3$ | $Cl^{\ominus}$ |
| I-9 | p-$OCH_3$ | p-$OCH_3$ | p-$OCH_3$ | $Cl^{\ominus}$ |
| I-10 | H | p-$C_2H_5$ | p-$C_2H_5$ | $Cl^{\ominus}$ |
| I-11 | H | m-$C_2H_5$ | m-$C_2H_5$ | $Cl^{\ominus}$ |
| I-12 | H | p-$C_3H_7$ | p-$C_3H_7$ | $Cl^{\ominus}$ |
| I-13 | H | p-$OC_2H_5$ | p-$OC_2H_5$ | $Cl^{\ominus}$ |
| I-14 | H | p-$OCH_3$ | p-$OCH_3$ | $Cl^{\ominus}$ |
| I-15 | H | p-$OCH_3$ | p-$OC_2H_5$ | $Cl^{\ominus}$ |
| I-16 | H | p-$OC_5H_{11}$ | p-$OCH_3$ | $Cl^{\ominus}$ |
| I-17 | H | p-$OC_8H_{17}$-n | p-$OC_8H_{17}$-n | $Cl^{\ominus}$ |
| I-18 | H | p-$C_{12}H_{25}$-n | p-$C_{12}H_{25}$-n | $Cl^{\ominus}$ |
| I-19 | H | p-$N(CH_3)_2$ | p-$N(CH_3)_2$ | $Cl^{\ominus}$ |
| I-20 | H | p-$NH_2$ | p-$NH_2$ | $Cl^{\ominus}$ |
| I-21 | H | p-OH | p-OH | $Cl^{\ominus}$ |
| I-22 | H | m-OH | m-OH | $Cl^{\ominus}$ |
| I-23 | H | p-Cl | p-Cl | $Cl^{\ominus}$ |
| I-24 | H | m-Cl | m-Cl | $Cl^{\ominus}$ |
| I-25 | p-CN | p-$CH_3$ | p-$CH_3$ | $Cl^{\ominus}$ |
| I-26 | p-SH | p-$OCH_3$ | p-$OCH_3$ | $Cl^{\ominus}$ |
| I-27 | H | p-$OCH_3$ | p-$OCH_3$ | 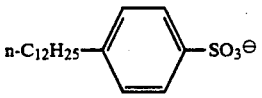 |

The tetrazolium compounds applicable to the invention may readily be synthesized in accordance with the method detailed in, for example, Chemical Reviews, Vol. 55, pp. 335–483.

The tetrazolium compounds represented by Formula I, which are applicable to the invention, may be used in an amount within the range of about not less than about 1 mg to about 10 mg and, preferably, not less than about 10 mg to about 2 g, each per mol of the silver halides to be contained in a silver halide photographic light-sensitive material of the invention.

The tetrazolium compounds represented by Formula I, which are applicable to the invention, may be used independently or in combination in a suitable proportion. It is also allowed to use the tetrazolium compounds of the invention together with any tetrazolium compounds out of the invention in a suitable proportion.

In the invention, a particularly preferable effect can be obtained when using the tetrazolium compounds of the invention together with an anion capable of coupling to them so as to reduce the hydrophilic property of them. The anions mentioned above include, for example, inorganic acid radicals such as those of perchloric acid, organic acid radicals such as those of sulfonic acid or carboxylic acid, and anionic activators. They include, typically, lower alkylbenzenesulfonic acid anions such as p-toluenesulfonic acid anion; p-dodecylbenzenesulfonic acid anions; alkylnaphthalenesulfonic acid anions; laurylsulfate anions; tetraphenylborons; dialkylsulfosuccinate anions such as di-2-ethylhexylsulfosuccinate anion; polyetheralcohol sulfuric acid ester anions such as cetylpolyethenoxysulfate anion; stearic acid anions; and polyacrylic acid anions.

The above-given anions may be added into a hydrophilic colloidal layer after they are mixed up in advance with the tetrazolium compounds of the invention, or they may also be added independently into either silver halide emulsion layers or hydrophilic colloidal layers, each containing or not containing the tetrazolium compounds of the invention.

The tetrazolium compounds of the invention are, preferably, the compounds represented by the following formula II:

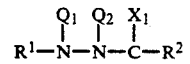

Formula II wherein $R^1$ represents a monovalent organic residual group; $R^2$ represents a hydrogen atom or a monovalent organic residual group; $Q_1$ and $Q_2$ each represents a hydrogen atom, an alkylsulfonyl group including those having substituents, an arylsulfonyl group including those having substituents; and $X_1$ represents an oxygen atom or a sulfur atom. Among the compounds represented by Formula II, the compounds are preferable when $X_1$ represents an oxygen atom and $R^2$ represents a hydrogen atom.

The above-mentioned monovalent organic residual groups represented by $R^1$ and $R^2$ include an aromatic residual group, a heterocyclic residual group and an aliphatic residual group.

The aromatic residual groups include, for example, phenyl groups, naphthyl groups, and those having the substituents such as an alkyl group, an alkoxy group, an acylhydrozino group, a dialkylamino group, an alkoxycarbonyl group, a cyano group, a carboxy group, a nitro group, an alkylthio group, a hydroxy group, a sulfonyl group, a halogen atom, an acylamino group, a sulfonamido group, and a thiourea group. The examples of the above-given groups having substituents include, typically, a 4-methylphenyl group, a 4-ethylphenyl group, a 4-oxyethylphenyl group, 4-dodecylphenyl group, a 4-carboxyphenyl group, a 4-diethylaminophenyl group, a 4-octylaminophenyl group, a 4-benzylaminophenyl group, a 4-acetoamido-2-methylphenyl group, a 4-(3-ethylureido)phenyl group, a 4-[2-(2,4-di-tert-butylphenoxy)butylamido]phenyl group, and a 4-[2-(2,4-di-tert-butylphenoxy)butylamido]phenyl group.

The heterocyclic residual groups include, for example, 5- or 6-membered single or condensed rings having at least one of oxygen, nitrogen, sulfur and selenium atoms, provided that they may have substituents. The typical heterocyclic residual groups include, for example, those of a pyrroline ring, a pyridine ring, a quinoline ring, an indole ring, an oxazole ring, a benzoxazole ring, a naphthoxyazole ring, an imidazole ring, a benzimidazole ring, a thiazoline ring, a thiazole ring, a benzthiazole ring, a naphthothiazole ring, a selenazole ring, a benzselanazole ring and a naphthoselenazole ring.

The above-given heterocyclic rings may be substituted with an alkyl group having 1–4 carbon atoms, such as a methyl group and an ethyl group; an alkoxy group having 1–4 carbon atoms, such as a methoxy group and an ethoxy group; an aryl group having 6–18 carbon atoms, such as a phenyl group; a halogen atom such as a chlorine atom and a bromine atom; an alkoxycarbonyl group; a cyano group; or an amino group.

The aliphatic residual groups include, for example, straight-chained or branched alkyl groups, cycloalkyl groups and those each having a substituent, an alkenyl group, and an alkynyl group.

The straight-chained or branched alkyl groups include, for example, those each having 1–18 carbon atoms and, preferably, 1–8 carbon atoms. The typical examples thereof include a methyl, ethyl, isobutyl and 1-octyl groups.

The cycloalkyl groups include, for example, those each having 3–10 carbon atoms, and they typically include, for example, a cyclopropyl group, a cyclohexyl group and an adamatyl group. The substituents to alkyl and cycloalkyl groups include, for example, alkoxy groups such as a methoxy group, an ethoxy group, a propoxy group and a butoxy group; an alkoxycarbonyl group; a carbamoyl group; a hydroxy group; an alkylthio group; an amido group; a siloxy group; a cyano group; a sulfonyl group; halogen atoms such as a chlorine atom, a fluorine atom and an iodine atom; aryl groups such as a phenyl group, a halogen-substituted phenyl group and an alkyl-substituted phenyl group. The typical examples of those substituted include a 3-methoxypropyl group, an ethoxycarbonylmethyl group, a 4-chlorocyclohexyl group, a benzyl group, a p-methylbenzyl group and a p-chlorobenzyl group. And, the alkenyl groups include, for example, an allyl group. The alkynyl groups include, for example, a propargyl group.

The preferable examples of the hydrazine compounds of the invention will be given below. It is, however, to be understood that the invention shall not be limited thereto at all.

II-1 1-formyl-2-{4-[2-(2,4-di-tert-butylphenoxy)butylamido]phenyl}hydrazine
II-2 1-formyl-2-(4-diethylaminophenyl)hydrazine
II-3 1-formyl-2-(p-tolyl)hydrazine
II-4 1-formyl-2-(4-ethylphenyl)hydrazine
II-5 1-formyl-2-(4-acetoamido-2-methylphenyl)hydrazine
II-6 1-formyl-2-(4-oxyethylphenyl)hydrazine
II-7 1-formyl-2-(4-N,N-dihydroxyethylaminophenyl)hydrazine -continued II-8 1-formyl-2-[4-(3-ethylthioureido)phenyl]hydrazine
II-9 1-thioformyl-2-{4-[2-(2,4-di-tert-butylphenoxy)butylamido]phenyl}hydrazine
II-10 1-formyl-2-(4-benzylaminophenyl)hydrazine
II-11 1-formyl-2-(4-octylaminophenyl)hydrazine
II-12 1-formyl-2-(4-dodecylphenyl)hydrazine
II-13 1-acetyl-2-{4-2-[2,4-di-tert-butylphenoxy)butylamido]phenyl}hydrazine
II-14 4-carboxyphenyl hydrazine
II-15 1-acetyl-1-(4-methylphenylsulfonyl)-2-phenyl hydrazine
II-16 1-ethoxycarbonyl-1-(4-methylphenylsulfonyl)-2-phenyl hydrazine
II-17 1-formyl-2-(4-hydroxyphenyl)-2-(4-methylphenylsulfonyl)-hydrazine
II-18 1-(4-acetoxyphenyl)-2-formyl-1-(4-methylphenylsulfonyl)-hydrazine
II-19 1-formyl-2-(4-hexanoxyphenyl)-2-(4-methylphenylsulfonyl)-hydrazine
II-20 1-formyl-2-[4-(tetrahydro-2H-pyrane-2-yloxy)-phenyl]-2-(4-methylphenylsulfonyl)-hydrazine
II-21 1-formyl-2-[4-(3-hexylureidophenyl)]-2-(4-methylphenylsulfonyl)-hydrazine
II-22 1-formyl-2-(4-methylphenylsulfonyl)-2-[4-(phenoxythiocarbonylamino)-phenyl]-hydrazine
II-23 1-(4-ethoxythiocarbonylaminophenyl)-2-formyl-1-(4-methylphenylsulfonyl)-hydrazine
II-24 1-formyl-2-(4-methylphenylsulfonyl)-2-[4-(3-methyl-3-phenyl-2-thioureido)-[henyl]-hydrazine
II-25 1-{{4-{3-[4-(2,4-bis-t-amylphenoxy)-butyl]-ureido}-phenyl}}-2-formyl-1-(4-methylphenylsulfonyl)-hydrazine

II-26

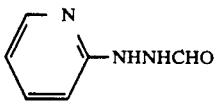

II-27

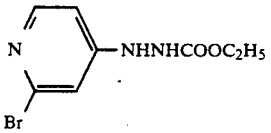

II-28

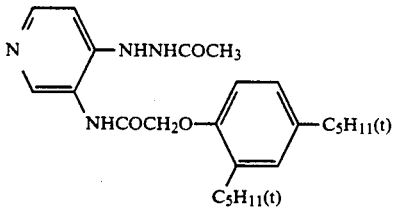

II-29

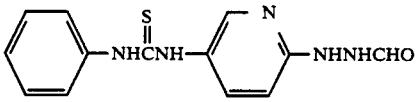

II-30

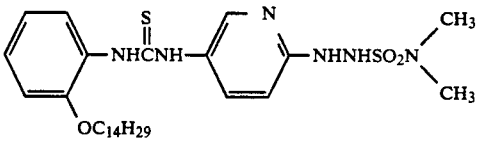

II-31

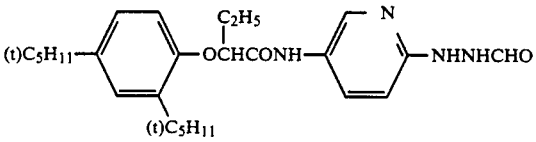

-continued
II-32
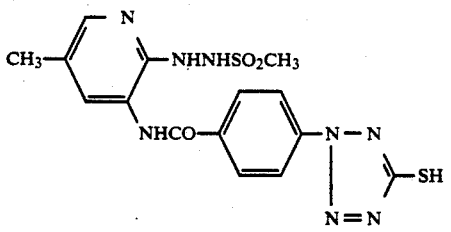
II-33
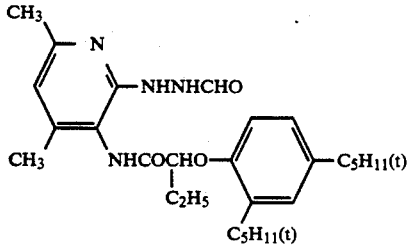
II-34
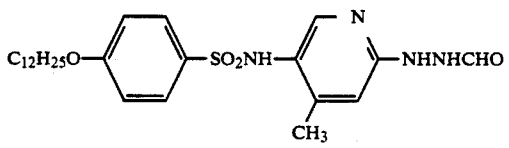
II-35
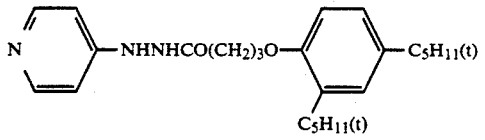
II-36
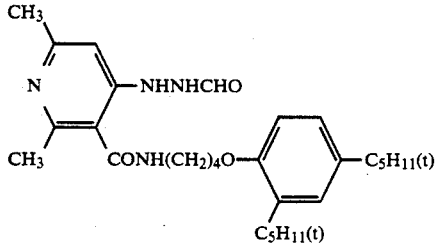
II-37
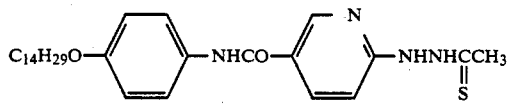
II-38
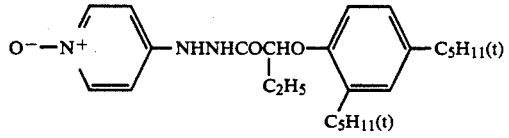
II-39
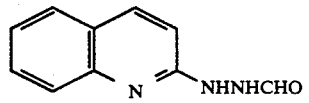
II-40
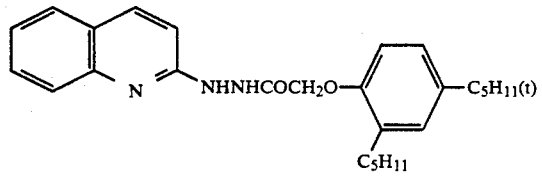

-continued
II-41
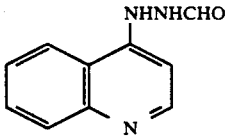
II-42
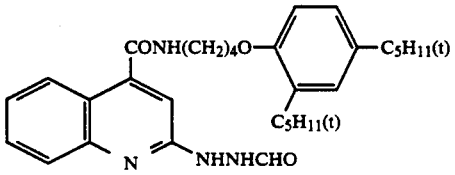
II-43
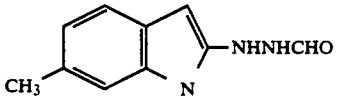
II-44
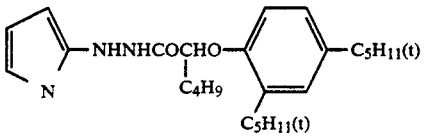
II-45
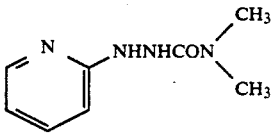
II-46
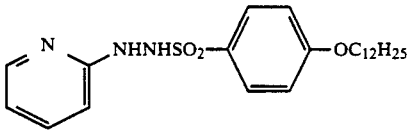
II-47
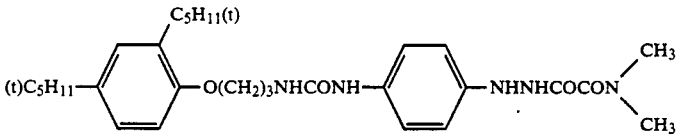
II-48
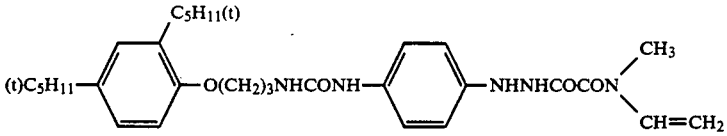
II-49
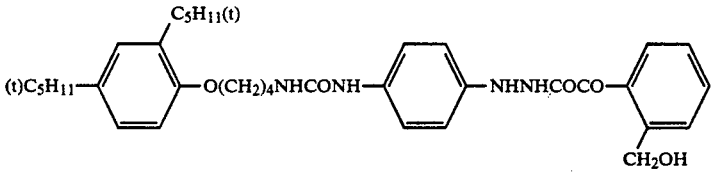
II-50
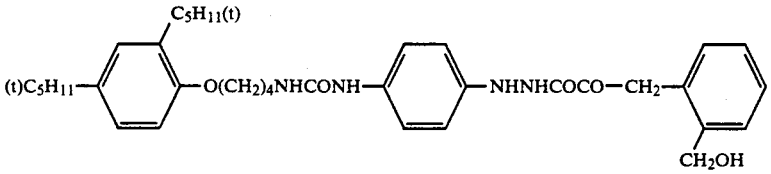

-continued

II-51

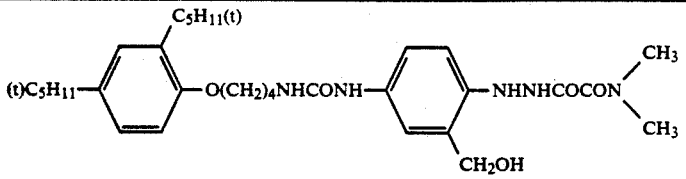

II-52

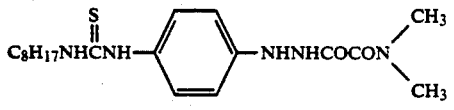

II-53

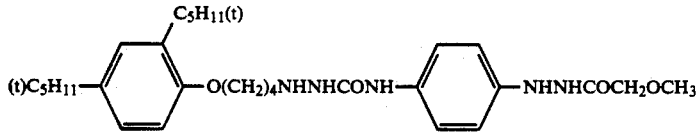

II-54

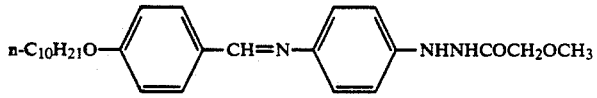

II-55

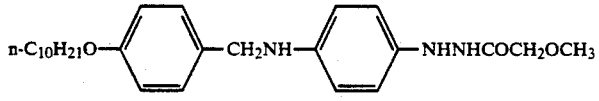

II-56

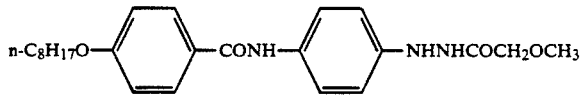

II-57

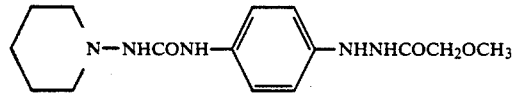

II-58

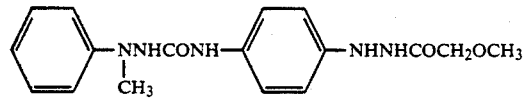

II-59

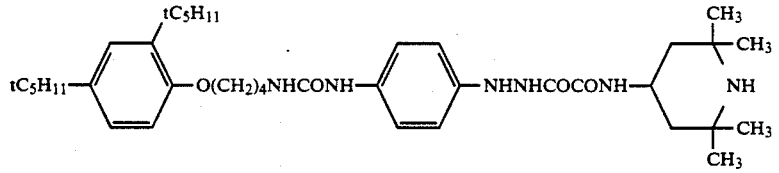

The hydrazine compounds represented by Formula II are added to the positions of a silver halide emulsion layer and/or a non-light-sensitive layer on the side of the silver halide emulsion layer arranged onto a support and, preferably, to the positions of the silver halide emulsion layer and/or the lower layer of the emulsion layer. The hydrazine compounds are to be added in an amount within the range of, preferably, $10^{-5}$–$10^{-1}$ mols and, further preferably, $10^{-4}$–$10^{-2}$ mols, each per mol of silver.

In the silver halide photographic light-sensitive materials relating to the invention, when a dye and/or a UV absorbent are contained in a hydrophilic colloidal layer, they may be mordanted with a cationic polymer.

To the photographic emulsions, various types of compounds may be added for preventing the light-sensitive materials from lowering the sensitivity or producing fog in the course of preparing, storing or processing the light-sensitive materials. To be more concrete, the above-mentioned various types of compounds include, for example, the following compounds well-known as the stabilizers, namely, azoles such as a benzothiazolium salt, nitroindazoles, triazoles, benzotriazoles and benzimidazoles including, particularly, those having a nitro- or halogen substituents; heterocyclic mercapto compounds such as mercaptothiazoles, mercaptobenzothiazoles, mercaptobenzimidazoles, mercaptothiadiazoles, mercaptotetrazoles including, particularly, 1-phenyl-5-mercaptotetrazole, mercaptopyridines and the above-given heterocyclic mercapto compounds each having such a water-soluble group as a carboxyl or a sulfone group; thioketo compounds such as oxazolinethione;

azaindenes such as tetraazaindenes including, particularly, 4-hydroxy-substituted (1,3,3a,7)tetraazaindenes; and stabilizers such as benzenethiosulfonic acids and benzenesulfinic acids.

Some of the examples of the compounds applicable thereto are given together with the original literature detailing them in K. Mees, 'The Theory of the Photographic Process', 3rd Ed., 1966.

The further details of the examples and the methods of application thereof may be referred to in the descriptions, for example, U.S. Pat. Nos. 3,954,474, 3,982,947 and 4,021,248 and Japanese Patent Examined Publication No. 52-28660/1977.

The silver halide photographic light-sensitive materials of the invention are also allowed to contain the following various additives. Namely, thickeners or plasticizers including, for example, the substances given in U.S. Pat. No. 2,960,404, Japanese Patent Examined Publication No. 43-4939/1968, West Germany Patent No. 1.904,604, Japanese Patent O.P.I. Publication No. 48-63715/1973, Japanese Patent Examined Publication No. 45-15462/1970, Belgian Patent No. 762,833, U.S. Pat. No. 3,767,410 and Belgian Patent 558,143, such as a styrene-sodium maleate copolymer and dextran sulfate; hardeners including, for example, those of the aldehyde, epoxy, ethyleneimine, active halogen, vinylsulfone, isocyanate, sulfonic acid esters, carbodiimide, mucochloric acid and acyloyl types; and UV absorbents including, for example, the compounds given in U.S. Pat. No. 3,253,921 and British Patent No. 1,309,349, such as, particularly, 2-(2'-hydroxy-5-tertiary butylphenyl)benzotriazole, 2-(2'-hydroxy-3',5'-di-tertiary butylphenyl)-benzotriazole, 2-(2-hydroxy-3'-tertiary butyl-5'-butyl phenyl)-5-chlorobenzotriazole and 2-(2'-hydroxy-3',5'-di-tertiary butyl phenyl)-5-chlorobenzotriazole. Further, the coating assistants, emulsifiers, permeability improvers for processing solutions, defoaming agents, or surfactants for controlling various physical properties of light-sensitive materials may be applied, such as anionic, cationic or amphoteric compounds. These are each described in, for example, British Patent Nos. 548,532 and 1,216,389, U.S. Pat. Nos. 2,026,202 and 3,514,293, Japanese Patent Examined Publication Nos. 44-26580/1969, 43-17922/1968, 43-17926/1968, 43-13166/1968 and 48-20785/1973, French Patent No. 202,588, Belgian Patent No. 773,459, and Japanese Patent O.P.I. Publication No. 48-101118/1973. Among them, an anionic surfactant having a sulfone group, such as a sulfonated succinic acid ester, sulfonated alkylnaphthalene and sulfonated alkylbenzene may preferably be used.

As for the anionic surfactants, it is preferable to use those containing any one of acid groups such as a carboxy group, a sulfo group, a phospho group, a sulfuric acid ester group and a phosphoric acid ester group, including, for example, an alkylcarboxylic acid salt, an alkylsulfonic acid salt, an alkelbenzenesulfonic acid salt, an alkylnaphthalenesulfonic acid salt, an alkylsulfuric acid ester, an alkylphosphoric acid ester, an N-acyl-alkyltaurine, a sulfosuccinic acid ester, a sulfoalkyl polyoxyethylene alkylphenylether and a polyoxyethylenealkyl phosphoric acid ester.

As for the amphoteric surfactants, it is preferable to use, for example, those of an amino acid, an aminoalkylsulfonic acid, an aminoalkylsulfuric acid ester or an aminoalkylphosphoric acid ester, an alkylbetaine and an amine oxide.

As for the cationic surfactants, it is preferable to use, for example, an alkylamine salt, an aliphatic or aromatic quaternary ammonium salt, a heterocyclic quaternary ammonium salt such as those of pyridium or imidazolium, and a phosphonium salt or a sulfonium salt each containing an aliphatic group or a heterocyclic ring.

As for the nonionic surfactants, it is preferable to use, for example: steroid type saponin; alkylene oxide derivatives such as polyethylene glycol, a polyethylene glycol/polypropylene glycol condensate, a polyethylene glycol alkylether or a polyethylene glycol alkylarylether; a polyethylene glycol ester; a polyethylene glycol sorbitan ester; a polyalkylene glycol alkylamine or a polyalkylene glycol alkylamide; a polyethylene oxide adduct of silicone; a glyceride derivative such as alkenyl succinic acid polyglyceride and an alkylphenol polyglyceride; the aliphatic esters of polyhydric alcohol; and the alkyl esters of sugar.

The antistatic agents include, for example, those described in Japanese Patent Examined Publication No. 46-24159/1971, Japanese Patent O.P.I. Publication No. 48-89979/1973, U.S. Pat. Nos. 2,882,157 and 2,972,535, Japanese Patent O.P.I. Publication Nos. 48-20785/1973, 48-43130/1973 and 48-90391/1973, Japanese Patent Examined Publication Nos. 46-24159/1971, 46-39312/1971 and 48-43809/1973, and Japanese Patent O.P.I. Publication No. 47-33627/1972.

In the preparation method of the invention, it is preferable to adjust the pH of a coating solution to be within the range of 5.3–7.5. In the case of multilayer coating, the coating solutions for each layer are mixed up together in the proportion of the amounts thereof to be coated and the pH of the resulting coating solution is preferable to have a pH within the above-mentioned range of 5.3–7.5. If the pH is lower than 5.3, the layers are hardened too slow to be preferable and, if it is higher than 7.5, the photographic characteristics are affected too much to be preferable.

In the light-sensitive materials of the invention, the component layers thereof may contain slipping agents including, for example, the higher aliphatic higher-alcohol esters described in U.S. Pat. Nos. 2,588,756 and 3,121,060, casein described in U.S. Pat. No. 3,295,979, the higher aliphatic calcium salts described in British Patent No. 1,263,722, and the silicon compounds described in British Patent No. 1,313,384 and U.S. Pat. Nos. 3,042,522 and 3,489,567. Besides the above, a liquid paraffin dispersion may also be used for the above-mentioned purpose.

As for the fluorescent whitening agents, those of stulbene type, triazine type, pyrazoline type, coumarin type and acetylene type may preferably be used.

The above-given compounds may be water-soluble or insoluble, provided, the insoluble compounds may be used in the form of dispersion.

It is also permitted to use a polymer latex contained in a silver halide emulsion layer or a backing layer. These techniques are detailed in, for example, Japanese Patent Examined Publication Nos. 39-4272/1964, 39-17702/1964 and 43- 13482/1968, and U.S. Pat. Nos. 2,376,005, 2,763,625, 2,772,166, 2,852,386, 2,853,457 and 3,397,988.

As for the binders for the light-sensitive materials of the invention, gelatin is used. It is also allowed to make a combination use of a gelatin derivative, a cellulose derivative, a graft polymer of gelatin and the other high molecules and, besides, the other protein, sugar derivatives, cellulose derivatives and hydrophilic colloids such as a monomeric- or copolymeric synthesized hydrophilic high molecular substance.

As for the gelatin, it is permitted to use an acid-treated gelatin and an oxygen-treated gelatin such as those detailed in 'Bulletin of Photographic Society of Japan', No. 16, p. 30, 1966, as well as a lime-treated gelatin. Besides the above, a hydrolized gelatin and an enzyme-decomposed gelatin may also be used. The gelatin derivatives applicable thereto include, for example, those obtained by making a reaction of gelatin with any one of various compounds such as an acid halide, an acid anhydride, an isocyanate, a bromoacetic acid, an alkane sultone, a vinylsulfon amide, a malein imide, a polyalkylene oxide, and an epoxy compound. The typical examples thereof are detailed in, for example, U.S. Pat. Nos. 2,614,928, 3,132,945, 3,186,846 and 3,312,553; British Patent Nos. 861,414, 1,033,189 and 1,005,784; and Japanese Patent Examined Publication No. 42-26845/1967.

The proteins include, for example, albumin and casein. The cellulose derivatives include, for example, the sulfuric acid esters of hydroxyethyl cellulose, carboxymethyl cellulose or cellulose. The sugar derivatives which may be applicable thereto include, for example, sodium alginate and a starch derivative which are to be used with gelatin in combination.

The graft polymers of gelatin and the other high molecular compounds each applicable thereto include, for example, those of gelatin grafted with a vinyl monomer, or the homopolymer or copolymer of vinyl type monomers such as acrylic acid, methacrylic acid and the esters thereof and the amide derivatives thereof, acrylonitrile and styrene. Particularly, it is preferable to use a graft polymer of gelating and a polymer having some extent of compatibility, such as a polymer containing acrylic acid, acrylamide, methacrylamide or hydroxyalkyl methacrylate. The examples thereof are given in U.S. Pat. Nos. 2,763,625, 2,831,767 and 2,956,884.

To the light-sensitive materials of the invention, a variety of additives may be so added as to meet the purposes of application.

The supports applicable to the light-sensitive materials of the invention include, for example, a support made of paper laminated thereon with an $\alpha$-olefin polymer such as a polyethylene, a polypropylene or an ethylene/butene copolymer; a flexible reflective support made of synthetic paper; a film support comprising a semi-synthetic or synthetic high molecular compound such as cellulose acetate, cellulose nitrate, polystyrene, polyvinyl chloride, polyethylene terephthalate, poly carbonate or polyamide; a flexible support comprising any one of the above-given films provided thereon with a reflective layer; and a support made of a metal.

Among the above-given supports, those made of polyethylene terephthalate are preferably used.

The support may have a sublayer.

The surface of the sublayer may usually be chemically or physically treated. The treatments applicable thereto include, for example, the surface-activation treatments such as a chemical treatment, a mechanical treatment, a corona-discharge treatment, a flame treatment, a UV ray treatment, a high frequency treatment, a glow-discharge treatment, an activated plasma treatment, a laser treatment, a mixed acid treatment, and an ozone treatment.

The sublayers are discriminated from the coated layers relating to the invention and shall not be limited to the points of time of and the conditions for coating the sublayers.

In the invention, it is allowed to use any filter dyes or the other dyes for various purposes such as an antihalation purpose. The dyes applicable thereto include, for example, a triallyl dye, an oxanol dye, a hemioxanol dye, a melocyanine dye, a cyanine dye, a styryl dye and an azo dye. Among them, the oxanol dyes, hemioxanol dyes and melocyanine dyes are useful. The typical examples of the dyes applicable thereto are given in West Germany Patent No. 616,007; British Patent Nos. 584,609 and 1,177,429; Japanese Patent Examined Publication Nos. 26-7777/1951, 39-22069/1964 and 54-38129/1979; Japanese Patent O.P.I. Publication Nos. 48-85130/1973, 49-99620/1974, 49-114420/1974, 49-129537/1974, 50-28827/1975, 52-108115/1977, 57-185038/1982 and 59-24845/1984; U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312; PB Report No. 74175; and Photographic Abstract, 1, 28, '21.

The above-given dyes are suitably applicable particularly to day-light contact light-sensitive materials. They are particularly preferable to be used so that the sensitivity thereof to the rays of light having 400 nm may be not less than 30 times as much as that to 360 nm.

When embodying the invention, it is allowed to use an organic desensitizer in which the sum of the anode and cathode potentials is positive on the polarograph detailed in Japanese Patent O.P.I. Publication No. 61-26041/1986.

Any light-sensitive material of the invention may be exposed to an electromagnetic wave belonging to a spectral region to which an emulsion layer constituting the light-sensitive material is sensitive. The light sources applicable thereto include, for example, any one of the well-known light sources such as natural rays of light, e.g., daylight, a tungsten lamp, a fluorescent lamp, an iodine-quartz lamp, a mercury lamp, a UV lamp emitting a microwave, a xenon-arc lamp, a carbon-arc lamp, a xenon-flash lamp, a cathode-ray tube flying-spot, various kinds of laser beams, an LED, an electron beam, the rays of light emitted from a fluorescent substance excited by X-rays, $\gamma$-rays or $\alpha$-rays. Besides the above, it is also allowed to obtain a preferable effects when using such a UV light source described in Japanese Patent O.P.I. Publication No. 62-210458/1987 is attached with an absorption filter capable of absorbing a wavelength of not more than 370 nm or when using a UV light source having a main light-emission wavelength within the range of 370–420 nm.

An exposure can be made to light for not only a period within the range of one millisecond—one second by an ordinary type of camera, but also a period of shorter than one microsecond, such as an exposure to light within the range of 100 nanoseconds—one microsecond by a cathode-ray tube or a xenon-flash tube. Besides, it is also allowed to make an exposure for a period of longer than one second. Such an exposure can be made either continuously or intermittently.

The invention can be applied to any various kinds of light-sensitive materials such as those for printing use, X-ray use, general negative film use, general reversal film use, general positive film use and direct positive film use. In particular, when the invention is applied to the light-sensitive materials for printing use which require an extremely high dimensional stability, a remarkable effect can be obtained.

In the invention, various types of developing processes can be applied to the light-sensitive materials, including, for example, the well-known processes such as a black-and-white, color, or reversal developing process. In particular, when the invention is applied to process the light-sensitive materials for printing use which should provide a high contrast, it can particularly be effective.

In the invention, the fixers applicable to process the light-sensitive materials are allowed to contain a thiosulfate and a sulfite and, besides, a variety of acids, salts, fixing accelerators, wetting agents, surfactants, chelating agents and hardeners. For example, the thiosulfates and sulfites include the potassium, sodium and ammonium salts thereof; the acids include sulfuric acid, hydrochloric acid, nitric acid, boric acid, formic acid, acetic acid, propionic acid, oxalic acid, tartaric acid, citric acid, malic acid and phthalic acid; and the salts include the potassium, sodium and ammonium salts of the above-given acids. The fixing accelerators include, for example, the thiourea derivatives and alcohols each having a triple bond in the molecules thereof, such as those described in Japanese Patent Examined Publication No. 45-35754/1970 and Japanese Patent O.P.I. Publication Nos. 58-122535/1983 and 58-122536/1983; and the thioether, the cyclodextran ether substance capable of making the anions thereof free, the crown ethers, diazabicycloundecene, and dihydroxyethylbutamine, such as those described in U.S. Pat. No. 4,126,459. The wetting agents include, for example, alkanolamine and alkylene glycol. The chelating agents include, for example, nitrilotriacetic acid and aminoacetic acids such as EDTA. And, the hardeners include, for example, chrome alum, potassium alum and, besides, an Al compound.

In the invention, the fixers are preferred to contain an Al compound so as to increase the hardness of a light-sensitive material. It is further preferred to contain the Al compound in an amount within the range of 0.1–3 g in terms of the Al content of the solution used.

The preferable concentration of the sulfurous acid contained in a fixer is within the range of 0.03–0.4 mols and, further preferably, 0.04–0.3 mols per liter of the fixer.

The pH of the fixer is within the range of, preferably, 3.9–6.5 and, most preferably, 4.2–5.3.

For the silver halide photographic light-sensitive materials relating to the invention, the processing temperature is, preferably, not higher than 50° C. and, particularly, within the range of, approximately, 25° C.–40° C., and the processing time is normally within two minutes to complete a process and, in particular, a preferable photographic image can be obtained even when a 5–60 second-rapid process is carried out.

EXAMPLES

The typical examples of the invention will be given below. It is, however, to be understood that the invention shall not be limited thereto.

Example 1

The negative type silver halide light-sensitive materials for daylight type contact use were prepared in the following manner.

Preparation of emulsions

A silver chlorobromide emulsion having a silver bromide content of 2 mol % was prepared in the following manner.

An aqueous solution containing the potassium salt of pentabromorhodium in an amount of 23.9 mg per 60 g of silver nitrate, sodium chloride and potassium bromide, and an aqueous silver nitrate solution were simultaneously mixed up while stirring in an aqueous gelatin solution at 40° C. by taking 25 minutes, so that the silver chlorobromide emulsions each having an average grain-size of 0.20 μm were prepared.

After adding 200 mg of 6-methyl-4-hydroxy-1,3,3a,7-tetrazaindene, as a stabilizer, into the resulting emulsions, the mixture was washed and desalted.

After adding 20 mg of 6-methyl-4-hydroxy-1,3,3a,7-tetrazaindene into the resulting emulsions, they were sulfur sensitized, respectively. After completing the sulfur sensitization, the necessary amounts of gelatin and 6-methyl-4-hydroxy-1,3,3a,7-tetrazaindene were added. The resulting mixtures were made to be 260 ml by adding water, so that the emulsions were prepared.

Preparation of latex L for adding emulsions

A solution was prepared by adding 0.25 kg of sodium dextran sulfate, KMDS manufactured by Meito Sangyo Co., and 0.05 kg of ammonium persulfate into 40 liters of water. To the resulting solution, a mixed solution of 4.51 kg of n-butyl acrylate, 5.49 kg of styrene and 0.1 kg of acrylic acid was added with stirring at the liquid temperature of 81° C. under the nitrogen atmospheric conditions by taking one hour. Then, 0.005 kg of ammonium persulfate was added. After further strring for 1.5 hours, the solution was cooled down. Then, the pH of the solution was adjusted to be pH 6 with aqueous ammonia.

The resulting latex solution was filtered through a GF/D filter manufactured by Whotman Co., and it was finished to make 50.5 kg by adding water and, thereby a monodisperse type latex L having an average particle-size of 0.25 μm was prepared.

The following additives were added into the resulting emulsion and the silver halide emulsion coating solution was prepared in the following manner.

Preparation of emulsion coating solution

After adding 9 mg of compound A, as a pasteurizer, into the resulting emulsion solution, the pH thereof was adjusted to be pH 6.5 with a 0.5-N sodium hydroxide solution, and 360 mg of the following compound T was then added. Further, the following materials were added in order: namely, an aqueous 20% saponin solution in an amount of 5 ml per mol of silver halide used, 180 mg of sodium dodecylbenzenesulfonate, 80 mg of 5-methylbenzotriazole, 43 ml of latex L for adding the emulsion, 60 mg of the following compound M, and 280 mg of an aqueous styrene.maleic acid copolymer as a thickener. Then, the mixture was made to be 475 ml by adding water, so that an emulsion coating solution was prepared.

Next, the emulsion protective layer coating solution was prepared in the following manner.

Preparation of the emulsion protective layer coating solutions

Pure water was added into gelatin. After swelling the mixture, it was dissolved at 40° C. Next, an aqueous 1% solution of the following compound Z as a coating aid, the following compound N as a filter dye, and the following compound D were each added in order into the solution. The resulting solution was adjusted to have a pH of 6.0 with citric acid. To the resulting solution, a matting agent was added comprising amorphous silica to make the amounts respectively shown in Table 1, so that emulsion protective layer coating solutions P-1 - P-7 were prepared.

TABLE 1

| Protective layer P. No. | Average particle size of matting agent <μm> | Amount of matting agent in particle size of smaller than 4 μm <mg/m²> | Amount of matting agent in particle size of not smaller than 4 μm <mg/m²> |
|---|---|---|---|
| 1 | 3 | 20 | 0 |
| 2 | 6 | 0 | 20 |
| 3 | 8 | 0 | 20 |
| 4 | 3 | 16 | 4 |
| 5 | 4 | 10 | 10 |
| 6 | 6 | 4 | 16 |
| 7 | 8 | 4 | 16 |

Compound T

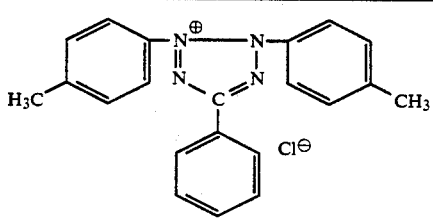

Compound Z

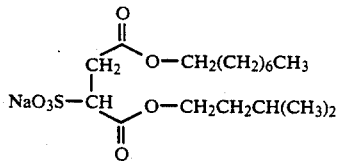

Compound M

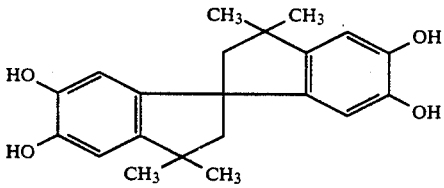

Compound N

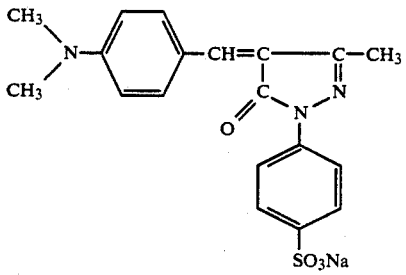

Compound A

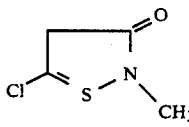

TABLE 1-continued

| Protective layer P. No. | Average particle size of matting agent <μm> | Amount of matting agent in particle size of smaller than 4 μm <mg/m²> | Amount of matting agent in particle size of not smaller than 4 μm <mg/m²> |
|---|---|---|---|
| Compound D | | 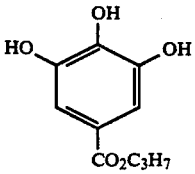 | |

Next, a backing layer coating solution was prepared in the following manner so as to coat a lower backing layer.

Preparation of backing layer coating solution B-1

Gelatin of 36 g was swelled by heating to be dissolved with water. Thereinto, an aqueous solution of the dyes, compounds C-1, C-2 and C-3 in the amounts of 1.6 g, 310 mg and 1.9 g, respectively, and the foregoing compound N in the amount of 2.9 g were added. Next, 11 ml of an aqueous 20% saponin solution and 5 g of the following compound C-4 as a physical property controller were added. Further, 63 mg of the following compound C-5 and thereafter compound C-6 as methanol solutions were added. Then, 800 g of a water-soluble styrene.-maleic acid copolymer was added to adjust the viscosity. The pH thereof was adjusted with an aqueous citric acid solution to be pH 5.4. Finally, 144 mg of glyoxal was added and the total amount of the resulting solution was made to be 960 ml, so that BC coating solution B-1 was prepared.

Compound C-2

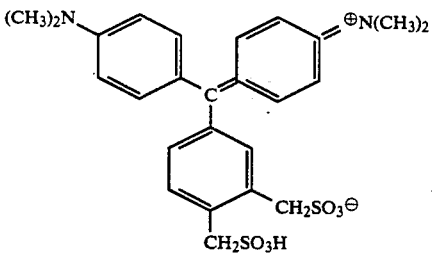

Compound C-2

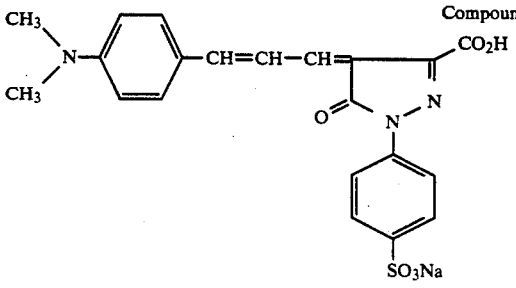

-continued

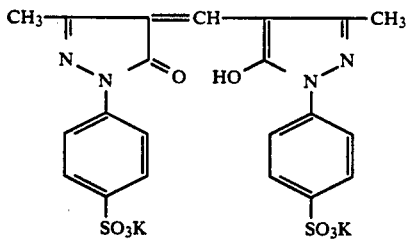

Compound C-3

A copolymer latex of

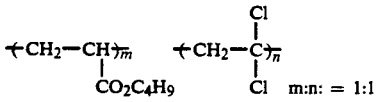

Compound C-4

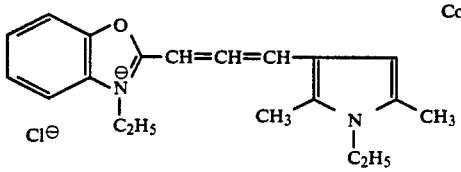

Compound C-5

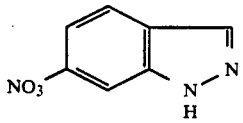

Compound C-6

Next, for coating the protective layer of the backing layer, the protective layer coating solution B-2 was prepared in the following manner.

Preparation of backing layer protective coating solution B-2

Gelatin of 50 g was swelled in water and heated to be dissolved. Then, 340 mg of 2-sulfonate-succinic acid bis(2-ethylhexyl)ester sodium salt was added, and 3.4 g of sodium chloride was then added. Further, 1.1 g of glyoxal and 540 mg of mucochloric acid were added. Thereto, globular-shaped polymethyl methacrylate having an average particle-size of 4 μm was added for a matting agent so as to make 40 mg/m². The total amount of the solution was made to be 1000 ml by adding water, so that protective layer coating solution B-2 was prepared.

Preparation of the samples subject to evaluation

Using a 100 μm-thick sublayered polyethylene terephthalate film support prepared in Example 1 of Japanese Patent O.P.I. Publication No. 59-19941/1984, backing layer coating solution B-1 and backing layer protective coating solution B-2 were simultaneously coated thereon.

Next, the emulsion layer coating solutions and emulsion protective layer coating solutions P-1 - P-7 were simultaneously multicoated on the opposite sides of the supports under the drying conditions shown in Table 2, so that samples subject to the evaluations, a-1 - a-16 were prepared, respectively.

In the preparations thereof, the amounts of gelatin coated were 2.0 g/m² to the backing layer, 1.5 g/m² to the backing protective layer, 2.0 g/m² to the emulsion layer and 1.0 g/m² to the emulsion protective layer. The silver contents thereof were 3.5 g/m².

Evaluation

Smooster value

The smooster values were measured by an instrument, Model SM-6B manufactured by Toei Electron Industrial Co., in the following manner. Every sample remaining unexposed to light was developed in the later-mentioned conditions and the moisture was adjusted for 2 hours at 23° C. and 48% RH.

Print-blurredness test

On a daylight printer, Model P-627FM manufactured by Dai-Nippon Screen Co., a 10% screen-tinted film was placed as an original document so as to face the layer surface thereof to the light source. A sheet of tissue paper available on the market was torn to pieces by hand so that the paper specks produced were evenly scattered on the original document. The original document was brought into close-contact with the emulsion surface of each sample and was then exposed to light for vacuum 8 seconds. After the exposed samples were processed under the following conditions, the processed samples were visually evaluated. The evaluation thereof were graded by 5 ranks.

Obverse/reverse discrimination

After processing the samples remaining unexposed under the conditions given below, the discrimination between the emulsion side and backing side of each sample was visually evaluated.

Aging preservability substitutive test

Every two of the samples were individually packaged. One of them was freeze-stored at −26° C. and the other was thermally stored in a 40° C.-thermostat chamber for 3 days. Each of the films was exposed by changing exposures to the foregoing daylight printer, and the maximum density of each film was obtained. The density measurements were made with a densitometer, Model PDA-65 manufactured by Konica Corporation.

| Processing step | Temperature, °C. | Time, sec. |
|---|---|---|
| Processing conditions | | |
| Developing | 34 | 15 |
| Fixing | 34 | 15 |
| Washing | at ordinary degrees | 10 |
| Drying | 40 | 9 |

| Developer formula | |
|---|---|
| Composition A | |
| Pure water, ion-exchange water | 150 ml |
| Disodium ethylenediaminetetraacetate | 2 g |
| Diethylene glycol | 50 g |
| Potassium sulfite, in an aqueous 55% W/V solution | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide | An amount for making the pH of the solution to be 10.9 |
| Potassium bromide | 4.5 g |
| Composition B | |
| Pure water, ion-exchange water | 3 ml |
| Diethylene glycol | 50 g |
| Disodium ethylenediaminetetraacetate | 25 mg |
| Acetic acid, in an aqueous 90% solution | 0.3 ml |
| 5-nitroindazole | 110 mg |
| 1-phenyl-3-pyrazolidone | 500 mg |

Before using the developer, the above-given compositions A and B were dissolved together in order into 500 ml of water and made to be one liter.

| Fixer formula | |
|---|---|
| Composition A | |
| Ammonium thiosulfate, in an aqueous 72.5% W/V solution | 230 ml |
| Sodium sulfite | 9.5 g |
| Sodium acetate.trihydrate | 15.9 g |
| Boric acid | 6.7 g |
| Sodium citrate dihydrate | 2 g |
| Acetic acid, in an aqueous 90% W/W solution | 8.1 ml |
| Composition B | |
| Pure water, ion-exchange water | 17 ml |
| Sulfuric acid, in an aqueous 50% W/W solution | 5.8 g |
| Aluminum sulfate, in an aqueous 8.1% W/W $Al_2O_3$ solution | 26.5 g |

Before using the fixer, the above-given compositions A and B were dissolved together in order to make to be one liter. The pH of the fixer was about 4.3.

The results thereof are shown in Table 2 below.

TABLE 2

| Sample a No. | Emulsion protective layer coating solution | Drying conditions Item A | Drying conditions Item B | Smooster value | Density lowering when heating | Print-blur test | Obverse/reverse discrimination |
|---|---|---|---|---|---|---|---|
| 1 | P-1 | 25° C. | 25 sec. | 10 | −0.22 | 2 | 4 |
| 2 | P-1 | 25 | 40 | 10 | −0.25 | 2 | 4 |
| 3 | P-1 | 19 | 25 | 11 | −0.23 | 2 | 4 |
| 4 | P-5 | 25 | 25 | 17 | −0.29 | 2 | 4 |
| 5 | P-5 | 25 | 40 | 17 | −0.32 | 2 | 4 |
| 6 | P-5 | 19 | 25 | 25 | −0.32 | 4 | 4 |
| 7 | P-1 | 19 | 35 | 10 | −0.07 | 2 | 4 |
| 8 | P-1 | 19 | 60 | 11 | −0.09 | 2 | 4 |
| 9 | P-1 | 6 | 60 | 13 | −0.08 | 2 | 4 |
| 10 | P-1 | 10 | 40 | 12 | −0.08 | 2 | 4 |
| 11 | P-2 | 10 | 40 | 45 | −0.07 | 5 | 3 |
| 12 | P-3 | 10 | 40 | 55 | −0.07 | 5 | 3 |
| 13 | P-4 | 10 | 40 | 27 | −0.09 | 4 | 5 |
| 14 | P-5 | 19 | 35 | 25 | −0.08 | 4 | 5 |
| 15 | P-5 | 19 | 60 | 28 | −0.07 | 4 | 5 |
| 16 | P-5 | 6 | 60 | 30 | −0.08 | 5 | 5 |
| 17 | P-5 | 10 | 40 | 30 | −0.08 | 5 | 5 |
| 18 | P-6 | 10 | 40 | 62 | −0.09 | 5 | 4 |
| 19 | P-7 | 10 | 40 | 65 | −0.07 | 5 | 4 |

Note 1: The levels ranked as not superior to 2 are not practically applicable and the levels ranked as not inferior to 4 are recognized to be improved more than the articles having been available on the market.
Note 2: Drying conditions:
Item A: A maximum surface temperature obtained within the range of the ratio of $H_2O$/gelatin of 800%-200% by weight.
Item B: A drying time required for obtaining the ratio of $H_2O$/gelatin from 800% to 200% by weight

Example 2

The tetrazolium compound T used in Example 1 was replaced by hydrozine compound HD to serve as a gradation hardener.

Consequently, the same results as in Example 1 were obtained; provided, the developer having the following composition B was herein used and, in the processing conditions, the processing temperature was 38° C. and the processing time was 20 seconds.

Compound HD

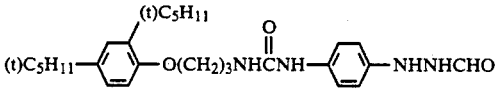

| Developer B | |
|---|---|
| Hydroquinone | 45.0 g |
| N-methyl-p.aminophenol ½ sulfate | 0.8 g |
| Sodium hydroxide | 15.0 g |
| Potassium hydroxide | 55.0 g |
| 5.sulfosalicylic acid | 45.0 g |
| Boric acid | 35.0 g |
| Potassium sulfite | 110.0 g |
| Disodium ethylenediaminetetraacetate | 1.0 g |
| Potassium bromide | 6.0 g |
| 5-methylbenzotriazole | 0.6 g |
| n-butyl.diethanolamine | 15.0 g |
| Add water to make | 1 liter |
| | pH = 11.6 |

Example 3

A negative film for darkroom photographic use was prepared in the following manner. The potassium pentabromorhodium salt, which was used when preparing the emulsion in Example 1, was herein used in an amount of 25 μg per 60 g of silver nitrate used, and silver chlorobromide having a silver bromide content of 25% was used. Then, the following sensitizing dye C was added when carrying out a chemical sensitization, thereby preparing a sample. The resulting sample was exposed to a tungsten lamp through a glass-made wedge.

When trying the same tests as in Example 1, except the above-mentioned changes, quite the same results as those of Example 1 were obtained.

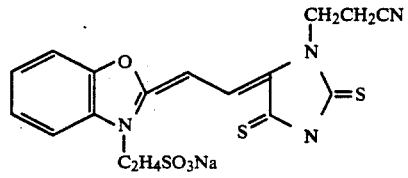

Example 4

A positive type silver halide photographic light-sensitive material was prepared in the following manner.

An aqueous gelatin solution being kept at 55° C. and pH=2 was mixed up with an aqueous gelatin solution containing rhodium trichloride.3 NaCl complex in an amount of 25 mg and potassium bromide in an amount of 2.5 mols, and an aqueous gelatin solution containing silver nitrate in an amount of 2.5 mols, each per mol of silver, by taking 70 minutes in a double-jet precipitation method so that the amounts of the ions added, with controlling the pH to be 2, could meet the growth of the grains.

When completing the mixture thereof, the pH was adjusted to be 5.5 and the water soluble salts were removed in an ordinary flocculation process. Then, gelatin was added, so that a monodisperse type silver bromide emulsion having an average grain-size of 0.2 μm could be prepared.

Preparation of emulsion $E_1$

To the resulting monodisperse type silver bromide emulsion, sodium carbonate was added to adjust the pH to be 7.5 and thiourea dioxide was then added in an amount of 12 mg per mol of silver halide. A ripening process was carried out at 65° C. until the maximum characteristics could be obtained and the fog was produced. After then cooling down to 40° C., aurochloric acid was added in an amount of 6 mg per mol of silver halide, so that emulsion $E_1$ was prepared. In addition, a protective layer was prepared in the following manner.

Preparation of protective layer

Pure water of 10 liters was added into 1 kg of gelatin and swelled. The resulting mixture was heated up to 40° C. to be dissolved together. Then, 66 g of dyes, i.e., the following compound Q-2, were added, and 500 ml of coating aids, i.e., an aqueous solution of the following compound Q-1, were added so that each of them could be dispersed in the gelatin, and 10 mg of the dyes, i.e., the following compound Q-3, were then added. To the resulting solution, the matting agent, i.e., amorphous silica, was added in the manner indicated in Table 1 of Example 1, so that protective layer coating solutions R-1 - R-7 were each prepared.

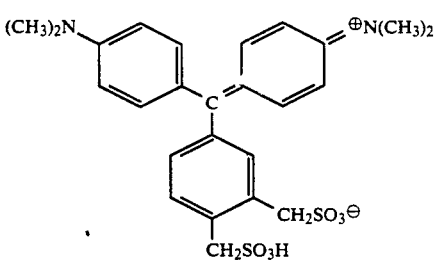

Compound Q-1

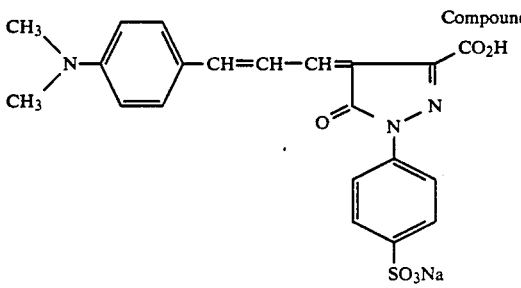

Compound Q-2

-continued

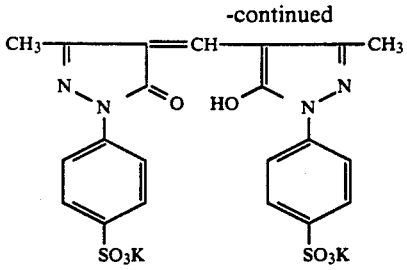

Compound Q-3

Preparation of emulsion coating solution $E_2$

The following compounds, Q-4 in an amount of 560 mg, Q-5 in the form of a latex polyethylene oxide compound in an amount of 8.5 g and C-6 in an amount of 280 mg, and dextrin in an amount of 5.6 g, each per mol of silver halide, were added into emulsion $E_1$. After then, emulsion coating solution $E_2$ was prepared while adjusting the viscosity to be 15 cp with a thickener at 35° C.

A copolymer latex of

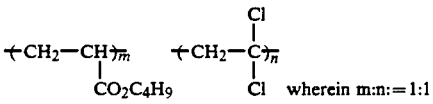

Compound Q-4

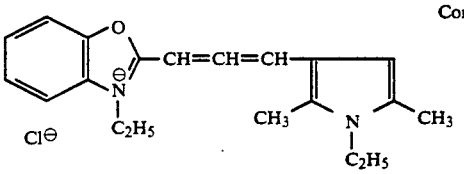

Compound Q-5

Preparation of backing layer coating solution B-3

B-3 coating solution was prepared in the same manner as in the backing layer coating solution B-1, except that compound C-6 was replaced by phenidone gelatin in an amount of 5 mg per gram and the pH was adjusted to be 5.4 with citric acid.

Preparation of the protective layer coating solution for backing layer, B-4

Protective layer coating solution B-4 was prepared in the same manner as in the foregoing protective layer coating solution B-2, except that any mucochloric acid was not used herein.

Preparation of samples subject to evaluation

The foregoing coating solutions were combined as shown in Table 3 and the resulting combined coating solution was coated each on both sides of a 100 μm-thick sublayered polyethylene terephthalate film used in Example 1 described in Japanese Patent O.P.I. Publication No. 59-19941/1984, so that the samples subject to evaluation were prepared as shown in Table 4. In this instance, on one side of the sublayered support, a lower backing layer was coated by making use of a coating solution B-3 so that the dried weight of gelatin could be 2 g/m$^2$ and, at the same time, on the lower backing layer, a backing protective layer was coated by making use of a protective layer coating solution B-4 so that the dried weight of gelatin could be 1 g/m$^2$, and they were then dried.

Next, on the other side of the support, an emulsion layer was coated so that the dried weight of gelatin could be 1.05 g/m$^2$ and the amount of silver coated could be 3.4 g/m$^2$. On the emulsion layer coated, an emulsion protective layer was coated by making use of protective layer coating solutions R-1 - R-7 so that the dried weight of gelatin could be 1 g/m$^2$ with adding the following compound H-2 as a layer hardener, at the same time when coating the emulsion layer under the drying conditions shown in Table 3, thereby preparing the samples subject to evaluation c-1 - c-16.

$$CH_2{=}CH{-}SO_2CH_2{-}O{-}CH_2SO_2CH{=}CH_2 \qquad \text{H-2}$$

The resulting samples were processed and then evaluated in the same manner as in Example 1; provided, however, that the 90% screen tinted original was used in samples c-1 - c-16, because these samples were of the positive type. The developer formula and the processing conditions were as same as in Example 1.

In the aging preservability substitutive tests, the samples each remaining unexposed were processed and the resulting densities thereof were measured. For the obverse/reverse discrimination tests, the samples were exposed to a daylight printer under the condition where the sample densities could be lowest at the time of development, and they were processed.

The results thereof are shown in Table 3.

TABLE 3

| Sample c No. | Emulsion protective layer coating solution | Drying conditions Item A | Drying conditions Item B | Smooster value | Density lowering when heated | Print-blur test | Obverse/reverse discrimination | Embodiment |
|---|---|---|---|---|---|---|---|---|
| 1 | R-1 | 25° C. | 25 sec. | 10 | −0.22 | 2 | 4 | Comparative |
| 2 | R-1 | 25 | 40 | 10 | −0.24 | 2 | 4 | Comparative |
| 3 | R-1 | 19 | 25 | 11 | −0.26 | 2 | 4 | Comparative |
| 4 | R-5 | 25 | 25 | 17 | −0.33 | 2 | 4 | Comparative |
| 5 | R-5 | 25 | 40 | 18 | −0.27 | 2 | 4 | Comparative |
| 6 | R-5 | 19 | 25 | 26 | −0.34 | 4 | 4 | Comparative |
| 7 | R-1 | 19 | 35 | 10 | −0.07 | 2 | 4 | Inventive (1) |
| 8 | R-1 | 19 | 60 | 12 | −0.09 | 2 | 4 | Inventive (1) |
| 9 | R-1 | 6 | 60 | 11 | −0.08 | 2 | 4 | Inventive (1) |
| 10 | R-1 | 10 | 40 | 13 | −0.09 | 2 | 4 | Inventive (1) |
| 11 | R-2 | 10 | 40 | 51 | −0.07 | 5 | 3 | Inventive (2) |
| 12 | R-3 | 10 | 40 | 54 | −0.07 | 5 | 3 | Inventive (2) |
| 13 | R-4 | 10 | 40 | 62 | −0.08 | 4 | 5 | Inventive (3) |
| 14 | R-5 | 19 | 35 | 28 | −0.10 | 4 | 5 | Inventive (3) |
| 15 | R-5 | 19 | 60 | 25 | −0.09 | 5 | 5 | Inventive (3) |
| 16 | R-5 | 6 | 60 | 29 | −0.08 | 5 | 5 | Inventive (3) |
| 17 | R-5 | 10 | 40 | 32 | −0.07 | 5 | 5 | Inventive (3) |
| 18 | R-6 | 10 | 40 | 62 | −0.08 | 4 | 4 | Inventive (3) |
| 19 | R-7 | 10 | 40 | 65 | −0.09 | 4 | 4 | Inventive (3) |

Inscriptions in every column correspond to Table 2.

What is claimed is:

1. A method of preparing a light-sensitive silver halide photographic material containing a matting agent having particle size of not less than 4 μm and present in an amount of about 4 to 80 mg/m$^2$ which comprises a support including on one side a silver halide emulsion layer and a coating containing water and a binder, comprising the step of:

drying the light-sensitive silver halide photographic material, while the percentage of the water to the binder is within the range of 800-200% by weight, at a surface-coating temperature not higher than 19° C. for a drying time period not less than 35 seconds.

2. A method of preparing a light-sensitive silver halide photographic material according to claim 1, wherein the particle size of the matting agent is less than 4 μm.

3. A method of preparing a light-sensitive silver halide photographic material according to claim 2, wherein the surface-coating temperature is not higher than 17° C.

4. A method of preparing a light-sensitive silver halide photographic material according to claim 2, wherein the drying time period is not less than 40 seconds.

5. A method of preparing a light-sensitive silver halide photographic material according to claim 1, wherein the surface-coating temperature is not higher than 17° C.

6. A method of preparing a light-sensitive silver halide photographic material according to claim 1, wherein the drying time period is not less than 40 seconds.

* * * * *